United States Patent [19]

Townson

[11] Patent Number: 4,493,380

[45] Date of Patent: Jan. 15, 1985

[54] HYDRAULIC STRAIGHT HOLE DRILL COLLAR

[75] Inventor: Jimmy D. Townson, Odessa, Tex.

[73] Assignee: Kenneth A. Freeman, Midland, Tex.

[21] Appl. No.: 427,137

[22] Filed: Sep. 29, 1982

[51] Int. Cl.[3] ..... E21B 7/06

[52] U.S. Cl. ..... 175/61; 175/73

[58] Field of Search ..... 175/61, 73, 75, 77, 175/79, 231, 320, 321, 323, 401

[56] References Cited

U.S. PATENT DOCUMENTS

| | | | |
|---|---|---|---|
| Re. 16,061 | 5/1925 | Thurston | 175/320 |
| 1,848,128 | 3/1932 | Hinderliter | 175/401 |
| 2,839,270 | 6/1958 | McCune et al. | 175/61 |
| 2,999,552 | 9/1961 | Fox | 175/323 |
| 3,338,069 | 8/1967 | Ortloff | 175/320 |
| 3,391,749 | 7/1968 | Arnold | 175/61 |
| 4,307,786 | 12/1981 | Evans | 175/61 X |

*Primary Examiner*—James A. Leppink
*Assistant Examiner*—Thuy M. Bui
*Attorney, Agent, or Firm*—Marcus L. Bates

[57] ABSTRACT

An improved drill collar for forming relatively straight holes in crooked hole type formations. One or more hydraulic drill collars are connected in series relationship within a drill string above a rotary bit at the point of tangency. Each drill collar includes at least one outwardly opening, longitudinally extending slot formed on the exterior thereof. The slot includes a back wall connected to confronting sidewalls and opposed end walls. One lower end of a slot commences in spaced relationship to the lower pin end of the collar. As the drill string is rotated, drilling fluid forms a cushion between the slot and the nearest sidewall of the borehole, thereby kicking or forcing the drill collar away from the borehole sidewall, which in turn forces the drill bit to penetrate in a downwardly direction back towards a vertical position. The borehole meanders a very small amount, as for example 3–4 degrees, rather than uncontrollably leaving the vertical and forming an excessively crooked hole. Various configurations and arrangements of slots are disclosed in the collar.

18 Claims, 16 Drawing Figures

HYDRAULIC STRAIGHT HOLE DRILL COLLAR

BACKGROUND OF THE INVENTION

Some geological formations enable rotary drill rigs to form a relatively straight hole as a wellbore is drilled from the surface of the earth down to the payzone. Other formations, often referred to as crooked hole type formations, cause the drill bit and string to meander or deviate away from vertical as the borehole is drilled by the bit. Deviation from vertical sometimes become substantial, and in aggravated cases, the hole can match the inclined angle of the formation.

A crooked borehole is undesirable because it is difficult to case, and undue localized stresses and strains are placed here and there on the casing. Furthermore, should a pumpjack be used to produce the well, the sucker rod invariably will contact and scrape against the production tubing because of the crooked hole causing excessive wear and premature failure of the rod or tubing string.

In some instances, it is possible to minimize the deviation of the hole by closely controlling the bit weight and rotary table speed. Others skilled in the art have proposed to circumferentially space grooves about a drill collar as taught in Fox U.S. Pat. No. 3,146,611; Toelke U.S. Pat. No. 3,267,695; Arnold U.S. Pat. Nos. 3,391,749 and 4,068,730 which disclose an apertured drill collar which proportedly reduces the borehole deviation.

Fox U.S. Pat. No. 3,146,611 discloses grooves 23 radially and circumferentially spaced from one another. Toelke U.S. Pat. No. 3,267,695 and Arnold U.S. Pat. Nos. 3,391,749 and 4,068,730 show an apertured drill collar. Lari U.S. Pat. No. 3,525,237; Herring U.S. Pat. No. 3,519,090; Bobo U.S. Pat. No. 3,419,094; Schurman U.S. Pat. No. 3,411,321; Scarborough U.S. Pat. No. 3,237,427; Dunn U.S. Pat. No. 2,841,366; Thurston U.S. Pat. Re. No. 16,061; and Ortloff U.S. Pat. No. 3,338,069 are other examples which show the status of the art in this respect, and reference is made to these references for further background of the invention.

The present Hydraulic Straight Hole Drill Collar differs from the above in that it straightens a hole when it starts to deviate from vertical, or becomes "crooked".

SUMMARY OF THE INVENTION

Method and apparatus for reducing borehole deviation while drilling in crooked hole type formations. A drill string is made up with a rotary bit on the bottom thereof, and one or more drill collars, made in accordance with the present invention, are included above the drill bit. Each drill collar is provided with at least one outwardly opening slot. The slots of the drill string are all aligned respective to one another, and are arranged parallel to the axial passageway of the drill string.

Each slot terminates in spaced relation respective to the pin and box end of the collar. The slot is of a width which causes it to sealingly engage the inside surface of the sidewall of the crooked borehole, and is of a depth to avoid significantly reducing the structural integrity of the collar.

As the drill string rotates, the collar and bit rotate therewith, and the slot contained within the drill collar repeatedly rotates into engagement with the sidewall of the borehole. The drilling mud contained within the slot hydraulically engages the borehole sidewall, and the drilling fluid forms a hydraulic cushion between the collar and the borehole sidewall. The presence of the fluid in the slot hydraulically kicks the collar away from the sidewall each revolution thereof, thereby forcing the bit to move back towards the vertical borehole axis.

Accordingly, as the dipping or inclined formation causes the bit to drill the borehole in a direction which slants away from vertical, the hydraulic action of the slotted collar or collars force the drill bit to return to the vertical, and the borehole therefore continues to meander a small amount toward and away from the vertical as the borehole forming operation continues.

The collar is positioned within the drill string at the expected or calculated point of tangency.

In the preferred form of the invention, the collar is provided with two aligned slots which are spaced from one another, spaced from the pin and box end of the collar, and aligned parallel respective to the axial passageway of the collar. All of the slots used in all of the collars of the drill string are aligned in this manner.

In another embodiment of the invention, slots are provided circumferentially spaced 30°, 120°, and 180° apart; and the configuration of the slots take on several different forms.

Accordingly, a primary object of the present invention is the provision of a drill collar for use in a drill string wherein the collar includes a longitudinal extending slot formed in a sidewall thereof which outwardly opens and consequently is always filled with circulating drilling mud, and cooperates with the inner wall surface of a crooked borehole in a manner to bias the drill string back towards a vertical position.

Another object of the invention is to provide a method of forming boreholes which incorporates a novel collar in the drill string, with the collar having longitudinally extending slots formed therein in which drilling mud is received, whereby the fluid filled slot hydraulically reacts with isolated surface areas of the borehole sidewall to maintain the drill string nearly vertical.

A further object of this invention is to disclose and provide a collar apparatus located in a drill string at the point of tangency for minimizing deviation of a crooked borehole.

A still further object of this invention is the provision of a drill string having an improved collar connected therein at the expected point of tangency which operates in a manner to reduce hole deviation.

Another and still further object of this invention is the provision of a drill string including an improved drill collar having an elongated slot incorporated therein to cause a much straighter borehole to be formed in crooked type formations.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
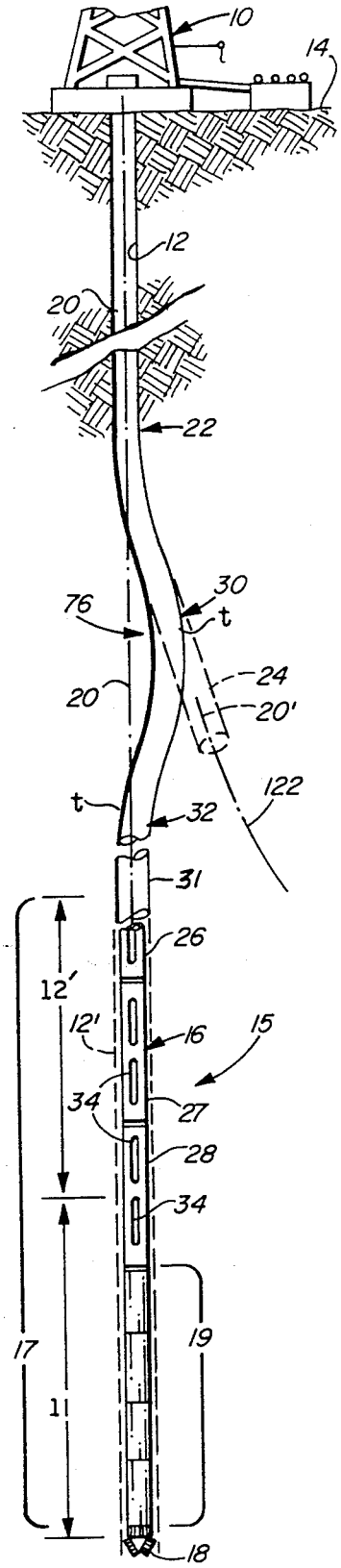
FIG. 1 is a part schematical, part diagrammatical representation of a borehole which is being formed according to the method of the present invention.

In FIG. 1 of the drawings, there is disclosed a rotary drilling rig 10 of conventional design which is forming a borehole 12 below the surface 14 of the ground. A drill string 16 terminates in a conventional rotary drill bit 18 at the lower end thereof.

Numeral 15 generally indicates the lower marginal end of the drill string, and usually comprises various different arrangements of stabilizers, reamers, and drill collars. The lower marginal end 15 of the drill string is usually referred to as the drill string hook-up. The components of a hook-up varies according to the desired bit weight, the type formation being penetrated, and the diameter of the borehole being formed by the bit.

The dot-dash line at numeral 20 generally indicates the desired vertical path followed by the bit 18. The borehole 12 is seen to commence to deviate at 22 from the vertical 20. The dot-dash representation of the borehole at 24 indicates an undesirable path assumed by the borehole when the hole is drilled without the present invention. Numeral 20′ indicates the axial centerline of the deviated borehole. The borehole continues at 122 in the absence of the present invention.

The hook-up 15 of the drill string 16 includes at least one, and preferably a plurality of hydraulic drill collars 26, 27, and 28 made in accordance with the present invention. Often 10–25 standard or prior art drill collars will be connected in a drill string at 19 in addition to 1–3 drill collars 26–28 made in accordance with the present invention. The hydraulic drill collars of the present invention causes the borehole to be urged back at 30 towards the vertical 20 where the borehole continues at 31 until the crooked type formation causes the borehole to again meander away from the vertical 20, whereupon the bit will again be forced back to the vertical 20 due to the action of the hydraulic collars, as will be explained more fully later on in this disclosure.

Each of the hydraulic collars 26, 27, and 28 are provided with at least one and preferably two spaced, longitudinally extending slots 34. The spaced slots 34 of collar 27, for example, prefer ably are aligned respective to one another and can also be aligned respective to the slots 34 of another drill collar 26 or 28, for example, if desired. However, it is not always necessary that all of the slots of all of the drill collars used to form part of the drill string hook-up be arranged circumferentially aligned with one another. It is necessary that the slots are all disposed parallel to the axial centerline of the drill string in the manner illustrated in FIGS. 1 and 3.

Figure 2:
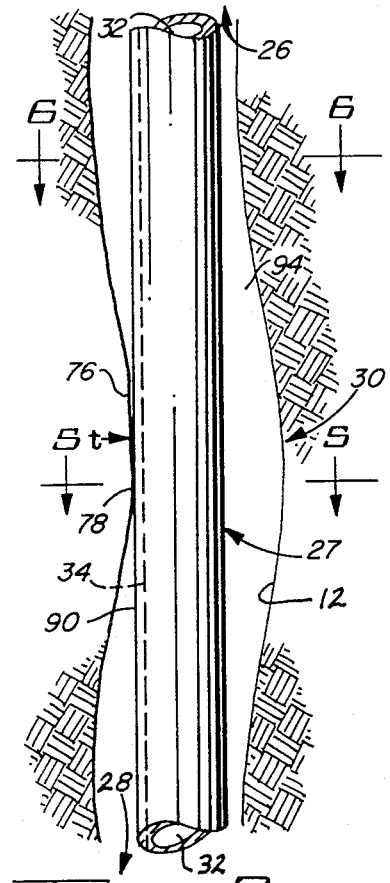
FIG. 2 is a fragmentary, enlarged, portion of the disclosure of FIG. 1.
Figure 5:
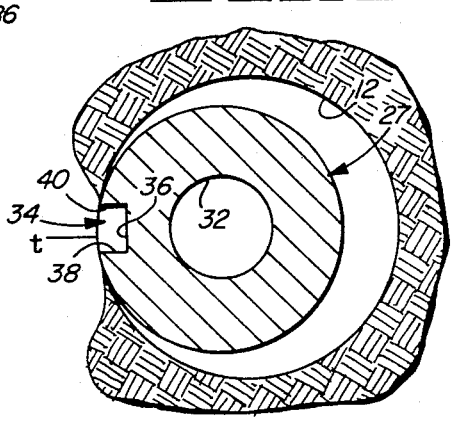
FIG. 5 is a cross-sectional view taken along line 5—5 of FIG. 2.

In FIGS. 1, 2, and 5, the arrow at t generally indicates the point of tangency where the drill string hook-up is tangentially brought into contact with the crooked borehole wall. The point of tangency varies 45 feet–98 feet above the bit, depending upon the bit diameter, bit weight, and the formation characteristics.

Figure 6:
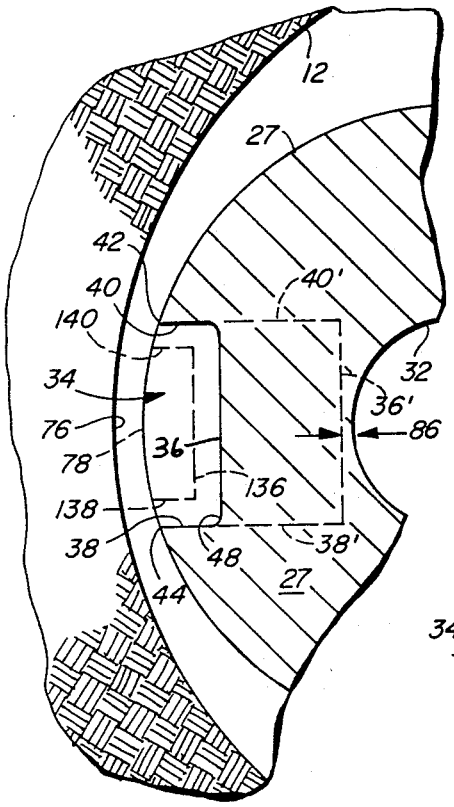
FIG. 6 is a cross-sectional view taken along line 6—6 of FIG. 2.
Figure 7:
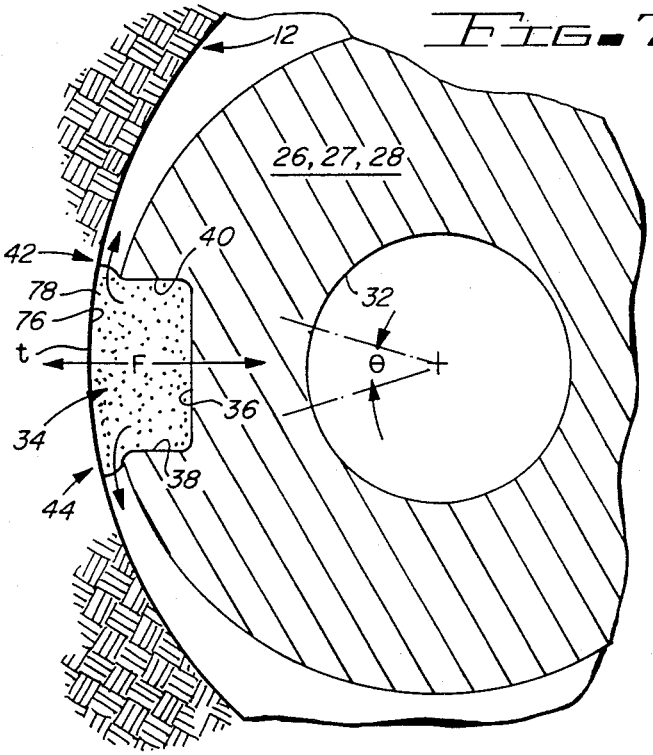
FIG. 7 is a fragmentary, part cross-sectional, part diagrammatical, part schematical illustration of the borehole forming operation illustrated in FIGS. 1 and 2.

In FIGS. 5, 6, and 7, the slot 34 is illustrated as having a back wall 36 connected to the innermost edge portion of opposed confronting sidewalls 38 and 40. In FIGS. 5 and 7, the slot has been rotated into sealed relationship respective to the nearest peripheral inside wall surface of the borehole 12.

In FIG. 6, the dot-dash lines 36′, 38′ and 40′ indicate that the slot 34 has been made excessively deep; while the dot-dash lines 136, 138, and 140 indicate that the slot has been made unduly narrow and shallow. Numerals 42 and 44 indicate the longitudinally extending edges which form the entrance into the slot. The corners at 48 preferably are chamfered to prevent crack growth.

Figure 3:
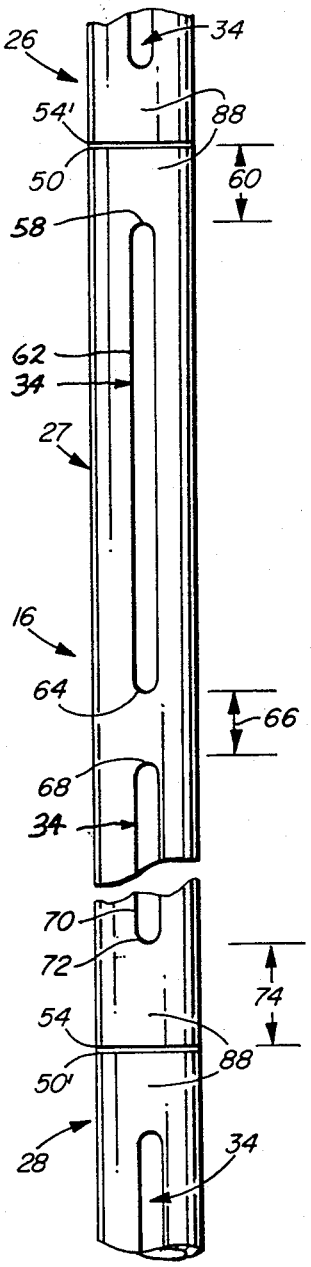
FIG. 3 is a broken, enlarged, fragmentary representation of part of the apparatus disclosed in FIGS. 1 and 2.
Figure 4:
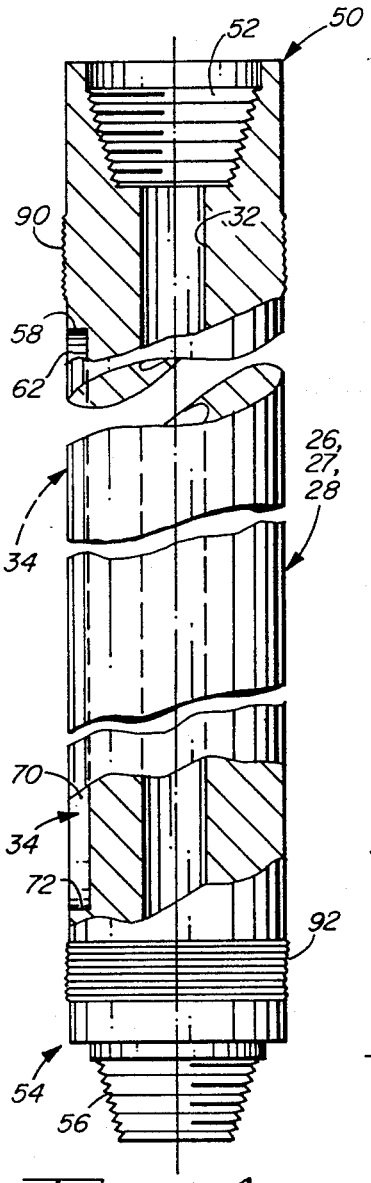
FIG. 4 is a broken, enlarged, part cross-sectional view of part of the apparatus disclosed in FIG. 3.

In FIGS. 3 and 4, together with other figures of the drawings, it will be noted that the collars 26, 27, and 28 are each provided with a standard box and pin end 50 and 54, respectively, having threaded surfaces 52 and 56, respectively. The collar of FIGS. 3 and 4 is provided with spaced, aligned slots 34, with there being an uppermost slot 62 having an upper end 58 spaced from box 50 an amount indicated by numeral 60 in FIG. 3. The lower end 64 of the upper slot 62 in FIGS. 3 and 4 is spaced an amount indicated by numeral 66 in FIG. 3 from the upper end 68 of the lower slot 70. The lower end 72 of slot 70 is spaced an amount indicated by numeral 74 from the shoulder of the pin end 54 of the collar.

The slots 34 of each of the collars 26, 27, and 28 are aligned longitudinally with one another in the illustrated manner of FIG. 3. The slots of each individual collar lie along a common line which is also parallel to the axial centerline of the axial passageway of the drill string.

In FIGS. 5 and 6, and in particular FIG. 7, it will be noted that an isolated area of the inner peripheral surface 76 or the borehole 12 is sealingly engaged by the outer peripheral surface 78 of the rotating hydraulic straight hole collar; and, therefore, as the slot of a collar rotatably contacts the point of tangency t in the deviated borehole, drilling fluid contained within the slot 34 sealingly engages the borehole sidewall for several degrees $\phi$ during each revolution thereof. This interaction between the collar and the sidewall hydraulically urges the collar away from the borehole wall, which in turn biases or kicks the drill bit back towards the desired vertical path 20 of the borehole, so that each time the wall of a crooked type formation is engaged by the collar slot and the bit commences to meander from the vertical, the resultant action of the rotating collar hydraulically kicks or biases or forces the bit in a direction to turn the borehole back towards the vertical. FIGS. 2, 5, 6, 7, and 15 show this described relationship between the collar, slot, and the deviated borehole at 76 and 78, at the point of tangency t.

Figure 8:
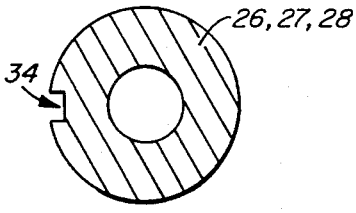
FIGS. 8–13 are cross-sectional views of the apparatus seen in FIG. 4 which set forth various different embodiments of the present invention.
Figure 9:
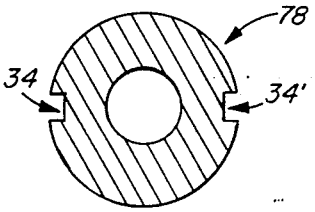
Figure 10:
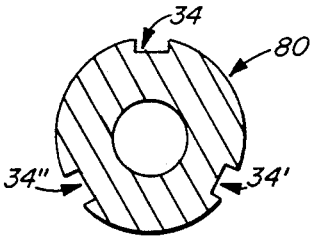

In FIG. 8, there is one slot provided along the longitudinal exterior surface of either of the collars 26, 27, and 28. In FIG. 9, the slots are provided along diametrically opposed exterior sidewalls of the collar, and therefore the slots are parallel to one another and circumferentially spaced 180° apart. In FIG. 10, the slots are 120° apart, with there being three longitudinally extending slots provided about the outer peripheral surface of the collar.

Figure 11:
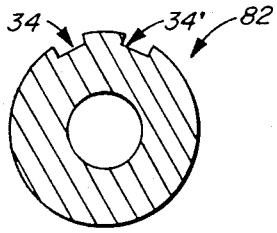

In FIG. 11, two closely adjacent slots have been milled into the sidewall of the collar and slightly displaced about 30° apart, with the slots preferably being within an included angle of 45°.

Figure 12:
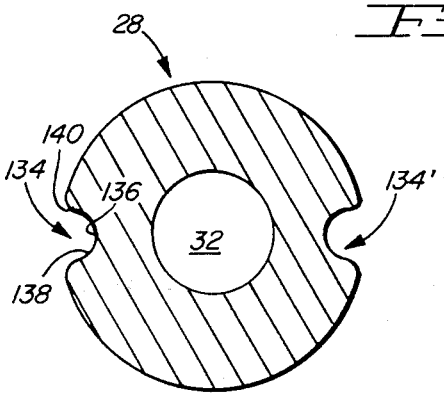

In FIG. 12, the hydraulic collar has been provided with opposed slots 134 and 134', each of which have a curved rear wall 136 and curved sidewalls 138 and 140. As another embodiment, the slots of FIGS. 8, 10, and 11 can be similarly configurated.

Figure 13:
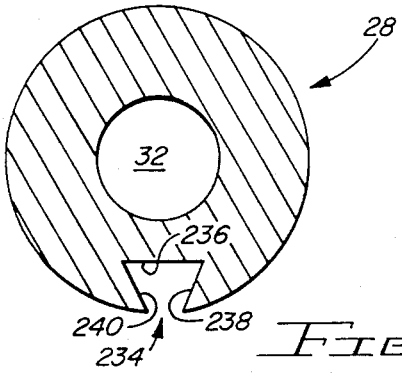

In FIG. 13, the slot 234 has a curved back wall made with the same curvature as the inner wall of passageway 32. The sidewalls 238 and 240 outwardly coverge towards one another, thereby giving the slot a dovetail configuration.

Figure 14:
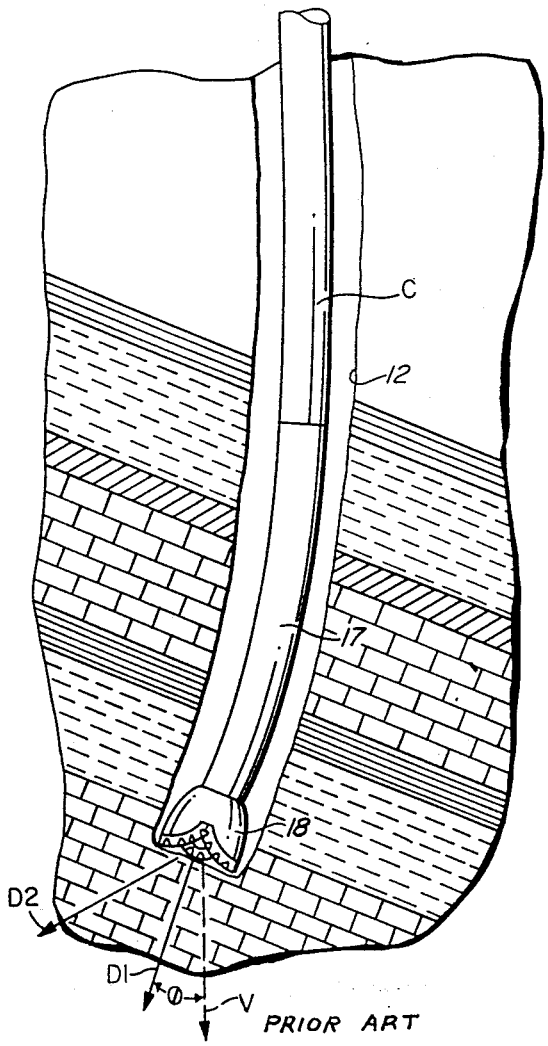
FIG. 14 is a cross-sectional view which diagrammatically illustrates a prior art drilling method; and, FIG. 15 diagrammatically illustrates the method of operation of the present invention; and, FIG. 16 is a plot of a pair of curves which show the improvement achieved with the present invention.

FIG. 14 is a prior art representation of a drill string having an ordinary hook-up 17 and C at the lower marginal end thereof. The bedding plane of the formation, along with the weight placed on the bit, determines the direction followed by the borehole. These factors, together with the angle $\phi$ between the vertical v and a perpendicular line D1 determine the point of tangency between the drill string and the borehole wall.

Figure 15:
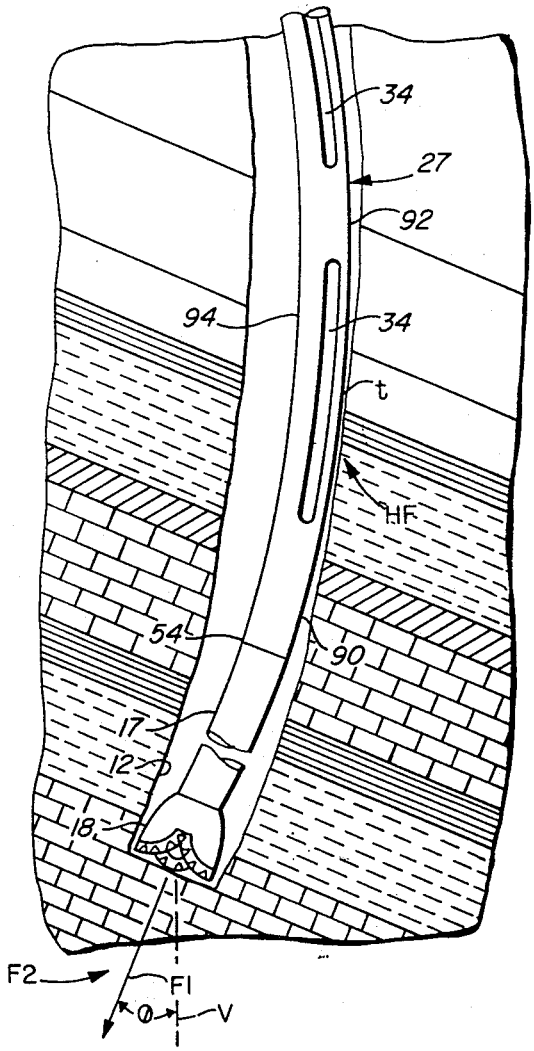

In FIG. 15, the hydraulic collar 27 is included in the drill string hook-up. The collar has been placed within the string to cause a medial length thereof to be located at the point of tangency, t. Drilling fluid flows from the bit 18, uphole at 90, through the slot 34 at the point of tangency, and up the borehole annulus at 92, with fluid also flowing up the annulus at 94. The rotating slot causes a reaction or hydraulic force HF to be effected at t. Fl is the bit weight, F2 is the resultant force caused by the hydraulic force at t. The force F1 is therefore resolved back towards the vertical v.

In FIG. 4, hard bonding can be applied as illustrated at 90, 92 about a limited marginal length of the collar, as an optional detail of design.

Figure 16:
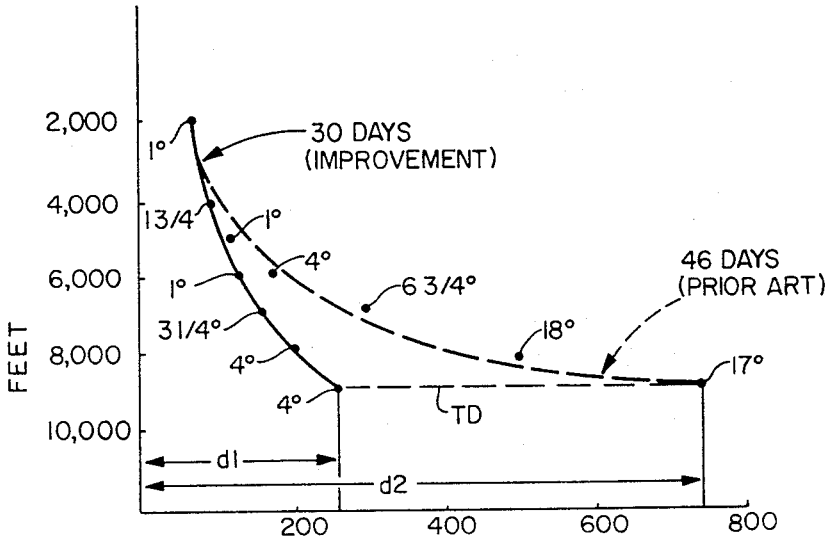

In FIG. 16, the solid curve is a plot of hole deviation of a borehole drilled while using a collar made in accordance with the present invention. It should be noted that the borehole deviated only 257 feet d1 and was inclined a maximum of 4° while making 8400 feet of hole. The dot-dash line shows a plot of hole deviation using a prior art collar while drilling in the same type formation. The second curve shows that the borehole deviated 772 feet d2 and was inclined a maximum of 18° while drilling to the same total depth TD. The borehole of the first curve required 30 days to drill, while the borehole of the second curve required 46 days of drilling time. The crooked type formation was encountered at about 6,000 feet, therefore the unforeseen advantages of the present invention were primarily realized over a drilling depth of approximately 2400 feet.

OPERATION

In operation, where a plurality of hydraulic collars are deemed desirable in the hook-up, the collars are made up in series relationship respective to one another. The slots 34 of one collar are aligned respective to one another in the illustrated manner of FIG. 3.

In some instances, it is desired to align the slots of one collar with the slots of an adjacent collar. This is achieved by torquing the collars together before the slot has been milled therein, indexing the collars respective to one another as indicated by numerals 88 in FIG. 3, and thereafter milling the slot along a line extending through the indexed locations 88. Each time the drill string is subsequently made up, the collars will properly make up with respect to one another to thereby properly align all of the slots respective to one another.

When making holes in a crooked type formation, the circulating drilling fluid or mud always completely fills the slots. Rotation of the drill string continually revolves the drilling fluid contained within the slots. Should the drill bit commence making hole at an angle $\phi$ respective to the preferred borehole axial centerline 20, the collar will be brought to bear against the surface 76 of the slanted part of the borehole at the point of tangency. At this time, the rotating drilling fluid contained within the slots wipes a marginal length of the borehole wall at t. As the pocket of drilling fluid hydraulically engages the borehole sidewall with this wiping action, the drill collar is hydraulically biased in a direction opposed to the inner surface 76 of the curved portion 30 of the borehole at t. The resultant of this generated hydraulic force HF is resolved in a direction Fl to urge the drill bit to penetrate in a direction which progresses the borehole back towards the vertical 20. Accordingly, as the hole deviates from the vertical, the cooperative action achieved between the borehole wall and the rotating, slotted, hydraulic drill collar influences the drill bit to penetrate in a direction which returns the hole to within about a few degrees of vertical. Therefore, while drilling in crooked type formations with the present invention, the hole continually deviates within a range of a few degrees, as for example between 3–4 degrees from vertical due to the remedial and unexpected action brought about by the use of the novel hydraulic drill collar.

Furthermore, with the hydraulic straight hole collar positioned at the point of tangency in the curved part of the borehole, in the illustrated manner of FIG. 2, for example, there is a pressure differential effected between areas 90 and 92 of a slot, which causes some of the drilling fluid to flow through the slot, as well as along the opposed side 94 of the collar. This flow of fluid through the slot at the point of tangency provides an action which contributes significantly towards influencing the drill bit to return to the vertical. Other phenomena may be involved which goes beyond the present analysis of the operation of the novel collar.

The following is a specific example of a drill string made in accordance with the present invention and used in a borehole while penetrating crooked type formations:

A rotary drilling rig was provided with 14 collars, one being a collar as seen at 26, 27, and 28. Slots 34 had been previously formed along one side thereof, with there being one slot each 360° of circumference. Two aligned, series, spaced slots 62 and 70 were milled into the collar for a length of 8 feet each, the collar was 30 feet in length, and the dimensions at 60, 66, and 74, respectively, were 6, 2, 6 feet, respectively. The milled slot was made 2 inches wide, and one-half inch deep, with the sidewalls 38 and 40 lying substantially normal to a flat rear wall 36. The slot corners 48 were slightly curved in the illustrated manner of FIG. 6 so as to avoid promotion of crack growth resulting from metal fatigue. The sharp edges were also removed from the longitudinal edges at 42 and 44 of the slots.

The borehole was drilled or formed using a standard rotary bit of the tri-cone type. After the hole had penetrated to a depth 8400 feet, the drill string was removed and the hole checked for deviation. The deviation of the borehole was found to be 3–4 degrees variation from vertical 20.

This borehole was formed in a geographical area having a crooked type formation which usually results in a crooked hole which is expected to deviate 7–15 degrees from the vertical 20 when using standard prior art collars.

In FIG. 6, numeral 86 indicates that the rear wall 36' has been placed too close to passageway 32 of the collar; and, therefore, the collar has been unduly weakened. In this instance, it is advantageous to make the slot of a smaller depth, as seen at 136 or 36, for example, and place two slots as seen in FIG. 11 adjacent to one another.

In order to prevent unduly weakening the collar, it is advantageous to utilize a single slot in drill collars less than 6 inches in outside diameter. The width of the slot preferably is 5–10 percent of the circumference. In larger drill collars, such as 6–9 inches diameter, two slots located 180° apart can be employed, as seen in the illustrated embodiment of FIG. 9, for example. In collars of larger diameters, 3 slots can be milled into the exterior surface of the collar, as seen in the illustrated embodiment of FIG. 10. The slot should be of sufficient cross-sectional area to provide a continual flow of drilling fluid thereinto while avoiding obstructions due to inclusion of debris. The slot should not be made excessively wide because it must "wipe" the borehole surface with the drilling fluid to provide the desired hydraulic counterforce respective to the drill bit.

One to three hydraulic straight hole drill collars 26–28 are used, depending upon the exactness with which the point of tangency can be ascertained. Additional standard prior art collars, along with the usual reamers, stabilizers, and other desired drill string components are included in the string.

The arrangement and configuration of the slots are selected in accordance with the size of the drilled hole, and the amount that the dip or inclined degree from the horizontal that the formation bed.

The present invention provides an inexpensive method by which relatively straight boreholes can be formed in crooked type formations. The present invention avoids sticking of the drill bit downhole in the borehole, reduces power consumption of the drilling rig, avoids subsequent trouble in casing the borehole, enhances the cementing job, and lengthens the life of the production equipment subsequently employed in producing the well. The present invention brings about the recited unexpected advantages which are achieved at the nominal cost of modifying a prior art drill collar in the manner set forth in the present disclosure.

The collar of this invention can be employed in most any drill string in lieu of prior art collars. Reamers and other subassemblies can be used in conjunction with the drill collar of this invention.

I claim:

1. In a rotary drill string having a bit connected at the lower end thereof by a drill string hook-up, said hook-up comprises a plurality of drill collars connected in the string at a location above the bit; each of said collars having an axial passageway formed therethrough, a pin at one terminal end and a box at the other terminal end of each collar by which the collars are connected together to form said hook-up, the improvement comprising:

said hook-up includes at least one upper collar having a longitudinally extending, outwardly opening slot formed along the sidewall thereof, said slot has a back wall spaced from the collar axial passageway, and opposed confronting sidewalls; there being an upper end of said slot which terminates in spaced relationship respective to said box end, and a lower end of said slot which terminates in spaced relationship respective to said pin end;

said hook-up further includes at least one lower collar having a continuous outer surface area uninterrupted by slots; so that said upper collar is placed at the point of tangency as the bit drills a crooked hole.

2. The improvement of claim 1 wherein the upper collar includes two spaced slots longitudinally aligned in series relationship with respect to one another, with the adjacent ends of said slots being spaced from one another at a medial length of the collar.

3. The improvement of claim 1 wherein a plurality of upper slotted collars are included in said hook-up, with the slots of one collar being longitudinally aligned respective to the slots of an adjacent collar, so that all of the slots of all of the upper collars are aligned respective to a common plane which intersects the axial passageway of the drill string.

4. The improvement of claim 1 wherein each said upper collar includes two coextensive slots placed 180° apart respective to one another.

5. The improvement of claim 1 wherein said upper collar has two slots arranged parallel and coextensive with respect to one another, and are spaced at least 45° apart.

6. The improvement of claim 1 wherein said upper collar includes three coextensive parallel slots spaced circumferentially 120° apart respective to one another.

7. The improvement of claim 1 wherein there is only one slot provided about the 360° circumferentially extending wall surface of the upper collar.

8. Method of reducing hole deviation while drilling in crooked hole type formations comprising the steps of:

forming a borehole with a drill string which includes a rotary bit connected at the lower end of the string by a hook-up;

including at least one upper drill collar and one lower drill collar in said hook-up;

forming a continuous outer surface area on said lower drill collar which is uninterrupted by slots;

forming a longitudinally extending outwardly opening slot along the exterior of the upper drill collar and arranging the slot parallel to and spaced from the axial passageway of the upper collar;

making the hook-up of a length which locates said upper drill collar at the point of tangency between the drill string and the borehole wall so that drilling fluid fills said slot and is caused to hydraulically engage the borehole wall at the point of tangency of a slanted borehole, thereby forcing the borehole towards the vertical during the drilling of a crooked hole.

9. The method of claim 8 and further including the step of forming two spaced slots which are longitudinally aligned in series relationship with respect to one another, and placing the adjacent ends of said slots in spaced relation with respect to one another and to a medial length of the collar.

10. The method of claim 8 and further including the steps of placing a plurality of collars in said drill string at the point of tangency and adjusting the weight on the bit so that at least one of the slots of one of the upper collars rotatably engages the borehole wall at said point of tangency.

11. The method of claim 10 and further including the steps of making two coextensive parallel slots and placing the slots 180° apart respective to one another.

12. The method of claim 10 wherein there is further included the step of forming a plurality of said slots and arranging said slots coextensive respective to one another, and spacing said slots within an included angle of 45°.

13. The method of claim 10 wherein there are three coextensive slots spaced circumferentially 120° apart respective to one another.

14. The method of claim 8 and further including the step of making an upper and lower longitudinally spaced slots about the 360° circumferentially extending wall surface of the upper collar;

arranging said longitudinally spaced slots in series relationship with respect to one another and placing the adjacent ends of said slots in spaced relation with respect to one another;

placing at least one said collar in said drill string at the point of tangency and adjusting the weight on the bit so that at least one of the slots of the collar rotatably engages the borehole wall at said point of tangency.

15. In a rotary drill string having a bit connected at the lower end thereof by a drill hook-up which has at least one upper drill collar and one lower drill collar connected in the string at a location above the bit; said upper and lower collars include an axial passageway formed therethrough, a pin at one terminal end and a box at the other terminal end of each collar by which the collars are connected into the string and thereby form said drill hook-up, the combination comprising:

said upper collar of said hook-up includes a longitudinally extending, outwardly opening slot formed along the sidewall of said upper collar, said slot has a back wall spaced from the upper collar axial passageway, and opposed confronting sidewalls;

there being an upper end of said slot which terminates in spaced relationship respective to said box end, and a lower end of said slot which terminates in spaced relationship respective to said pin end of the upper collar;

said lower collar has an uninterrupted outer surface, so that said hook-up can be made of a length to place said upper collar at the point of tangency in a crooked hole.

16. The combination of claim 15 wherein there are two spaced slots longitudinally aligned in series relationship with respect to one another, with the adjacent ends of said slots being spaced from one another and from a medial length of the upper collar.

17. The combination of claim 16 wherein a plurality of said lower and upper collars are included in said drill hook-up, with the slots of one upper collar being aligned respective to the slots of an adjacent upper collar, so that all of the slots of all of the upper collars are aligned respective to a common plane which intersects the axial passageway of the upper collar.

18. The combination of claim 16 wherein each said upper collar includes two coextensive slots placed 180° apart respective to one another.

* * * * *